US005334003A

United States Patent [19]

Gardner et al.

[11] Patent Number: 5,334,003

[45] Date of Patent: Aug. 2, 1994

[54] AIR VALVING MECHANISM, IN COMBINATION WITH A DOUBLE DIAPHRAGM PUMP SUBASSEMBLY

[75] Inventors: Richard K. Gardner, Montpelier; Gordon M. Schroeder, New Bavaria, both of Ohio

[73] Assignee: The Aro Corporation, Bryan, Ohio

[21] Appl. No.: 8,443

[22] Filed: Jan. 25, 1993

[51] Int. Cl.[5] ..... F04B 43/06

[52] U.S. Cl. ..... 417/393; 91/329

[58] Field of Search ..... 417/393, 395; 91/304, 91/309, 329

[56] References Cited

U.S. PATENT DOCUMENTS

| | | | |
|---|---|---|---|
| 2,307,566 | 1/1943 | Browne | 417/393 |
| 3,652,187 | 3/1972 | Loeffler | 417/393 |
| 3,782,863 | 1/1974 | Rupp | 91/329 |
| 3,791,768 | 2/1974 | Wanner | 417/393 |
| 4,019,838 | 4/1977 | Fluck | 91/304 |
| 4,172,698 | 10/1979 | Minz et al. | 417/393 |
| 4,406,596 | 9/1983 | Budde | 417/393 |
| 4,472,118 | 9/1984 | Rupp | 417/393 |

FOREIGN PATENT DOCUMENTS

| | | | |
|---|---|---|---|
| 1172904 | 1/1981 | Canada | 417/393 |
| 3940629 | 6/1991 | Fed. Rep. of Germany | 417/393 |

*Primary Examiner*—Richard A. Bertsch
*Assistant Examiner*—Peter Korytnyk
*Attorney, Agent, or Firm*—Walter C. Vliet; Bernard J. Murphy

[57] ABSTRACT

A double diaphragm pump subassembly, having a pair of diaphragm mounting plates, wholly confines an air valving mechanism between the plates. The mechanism is modular in nature, being substantially devoid of fasteners, and is nested in the plates for easy removal and parts replacement.

17 Claims, 4 Drawing Sheets

AIR VALVING MECHANISM, IN COMBINATION WITH A DOUBLE DIAPHRAGM PUMP SUBASSEMBLY

BACKGROUND OF THE INVENTION

This invention pertains to double diaphragm pumps, and in particular to an air valving mechanism in combination with a double diaphragm pump subassembly.

Prior art air valving mechanisms, for double diaphragm pumps, commonly use conventional spool valves, or the like, which exhaust the motive air through the valve. Typically, these exhaust the air through blocks, plates, and such, which have right-angularly formed air passages therefor. Undesirably, these passages promote the formation of ice on the internal, working parts of the valving mechanism and consequently, subject the mechanism to malfunctioning.

The air valving mechanisms known in the prior art, further, are external to the diaphragm-supporting plates, have a great number of components and parts, and require an appreciable number of fasteners therein.

The foregoing notes limitations known to exist in present devices. Thus, it is apparent that it would be advantageous to provide an alternative directed to overcoming one or more such limitations. Accordingly, a suitable alternative is provided, including features more fully disclosed hereinafter.

SUMMARY OF THE INVENTION

In one aspect of the invention, this is accomplished by providing an air valving mechanism in combination with a double diaphragm pump subassembly, comprising a pair of plates having confronting cavity recesses formed therein, fastened together, defining a chamber therebetween, and a pump-operating air valving mechanism, wherein said mechanism is wholly confined with said chamber.

The foregoing, and other aspects of the invention, will become apparent from the following detailed description of an embodiment of the invention, when considered in conjunction with the accompanying drawing figures.

BRIEF DESCRIPTION OF THE DRAWING FIGURES

DETAILED DESCRIPTION

Figure 2:
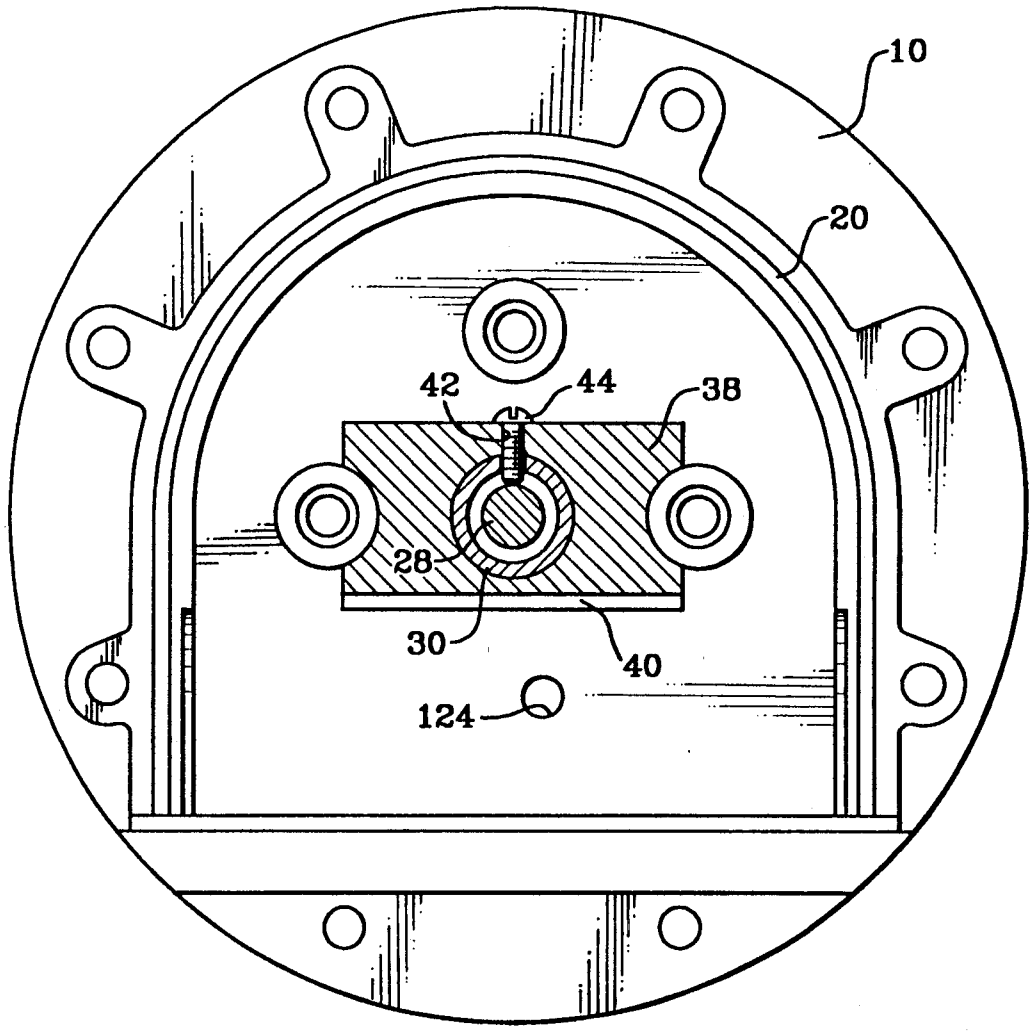
FIG. 2 is a partial cross-sectional view illustrating an embodiment of cross-sectional portions of FIG. 1.

Referring now to the drawings, a pair of plates 10 and 12, which have confronting cavity recesses 14 and 16 formed therein, are fastened together by bolts 18 (only one of which is shown). Fluid seals 20 and 22 are confined within the plates' parting line. The plates 10 and 12 have apertures 24 and 26 formed therein to accommodate the diaphragm-actuating rod 28 slidably therethrough. A bushing 30, set in the apertures 24 and 26, and held therein by retaining rings 32, receives the rod 28 therein. Intermediate the length of the rod 28 is an annular recess 34, and the bushing 30 has a short, axial slot 36 formed therein. Mounted about the bushing 30 is a through-bored block 38 which has an axial relief 40, in the outer surface thereof, along a length thereof. The block 38 has a threaded bore 42 formed therein, intermediate the length thereof, which opens onto the center thereof. A machine screw 44 is threadedly engaged with the bore 42, and the leading end of the shank of the screw is slidably disposed through the slot 36 and into the annular recess 34.

Figure 3:
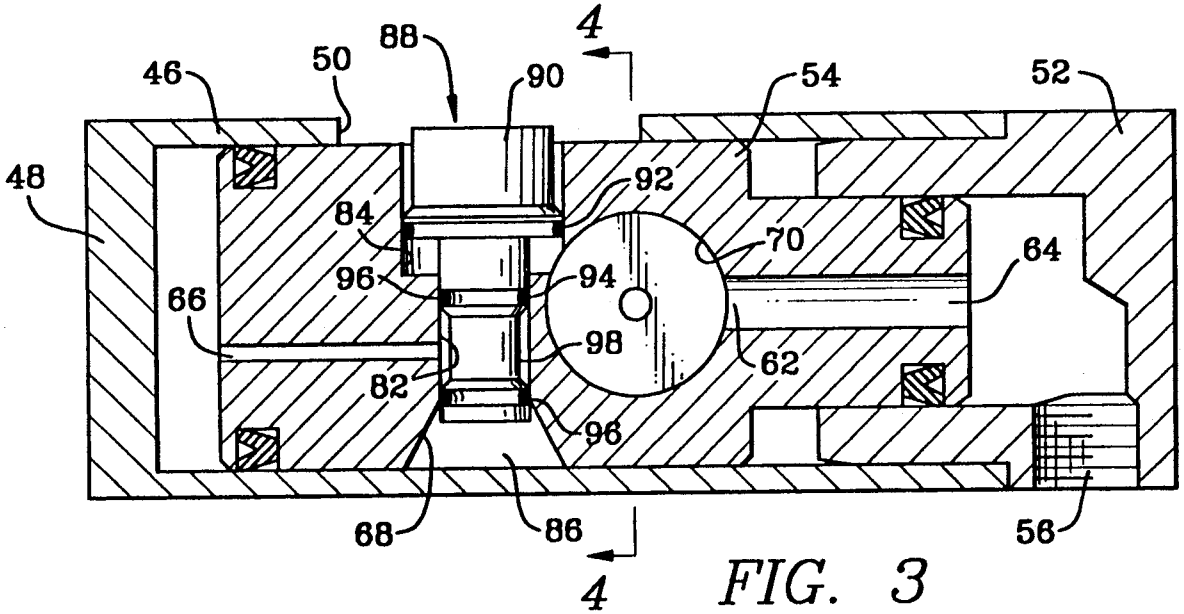
FIG. 3 is an axial cross-sectional view of an embodiment of the cylinder and piston of the invention.
Figure 4:
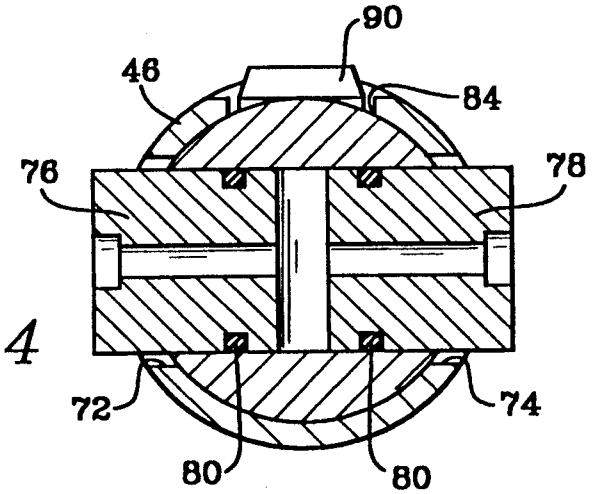
FIG. 4 is a cross-sectional view taken along section 4—4 of FIG. 3.

With particular reference to FIGS. 3 and 4, a cylinder 46, closed at one end 48, has a slot 50 formed therein. At the end of the cylinder 46, opposite the closed end 48, is an annular-walled plug 52. The cylinder has a given, inside diameter, and the plug 52 has an inside diameter smaller than that of the cylinder 46. A piston 54, having two outside diameters, corresponding to the aforesaid inside diameters, is slidably disposed in the cylinder 46 and plug 52. Adjacent an end of the plug 52 there is a tapped hole 56, the same being provided to receive therein a compressed air inlet fitting 60 (FIG. 6).

The piston 54 has a first, axial bore 62 formed therethrough, said bore 62 having a first portion 64, and a second portion 66 which are out of axial alignment with each other. Portion 66 opens onto an end of the piston 54 and, internally, onto a second, transverse bore 68 formed fully through the piston 54. Portion 64 opens onto the opposite end of the piston 54, for communication with the tapped hole 56 and fitting 60, and, internally onto a third, transverse bore 70. Bores 68 and 70 are in open communication with each other. The cylinder 46, on opposite sides thereof, has apertures 72 and 74 formed therein. The latter are in alignment with the bore 70. Axially bored, round valves 76 and 78 are slidably disposed in bore 70, and have 0-ring seals 80 fitted thereabout.

Bore 68 has an intermediate portion 82 of a given inside diameter, a contiguous portion 84 of greater, inside diameter which opens onto said slot 50, and another contiguous portion 86 with an outwardly widening termination which opens externally of said piston and opposite said portion 84. A button-headed valving element 88 is slidably disposed in bore 68; its headed portion 90 having an 0-ring seal 92 thereabout, is in said portion 82 of bore 68. Element 88 further has a shank 94 with a pair of spaced-apart 0-ring seals 96 thereabout. Intermediate the seals 96, the shank 94 has an annular relief 98 formed therein.

Figure 6:
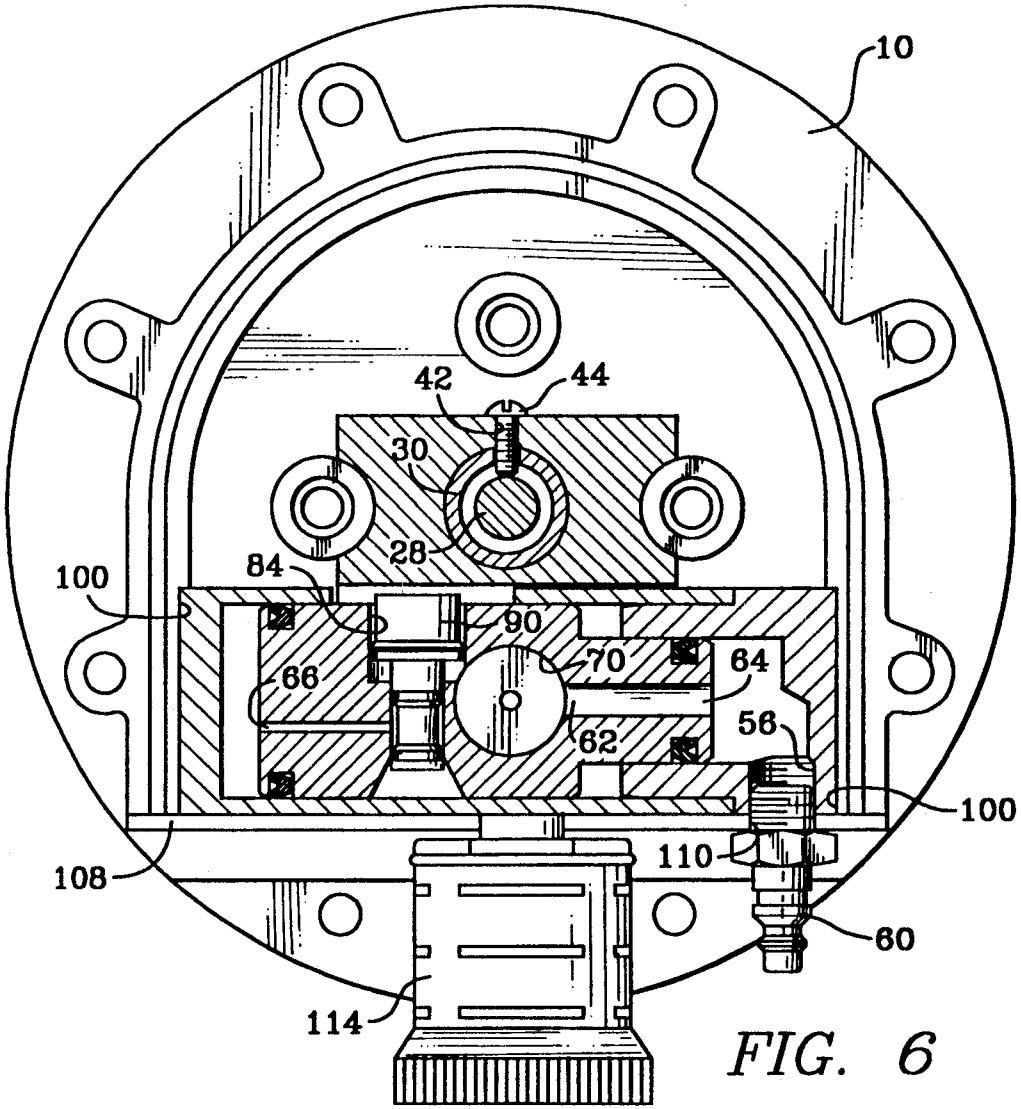
FIG. 6 is a view, like that of FIG. 2, showing an embodiment of the piston and cylinder nested between the plates.
Figure 5:
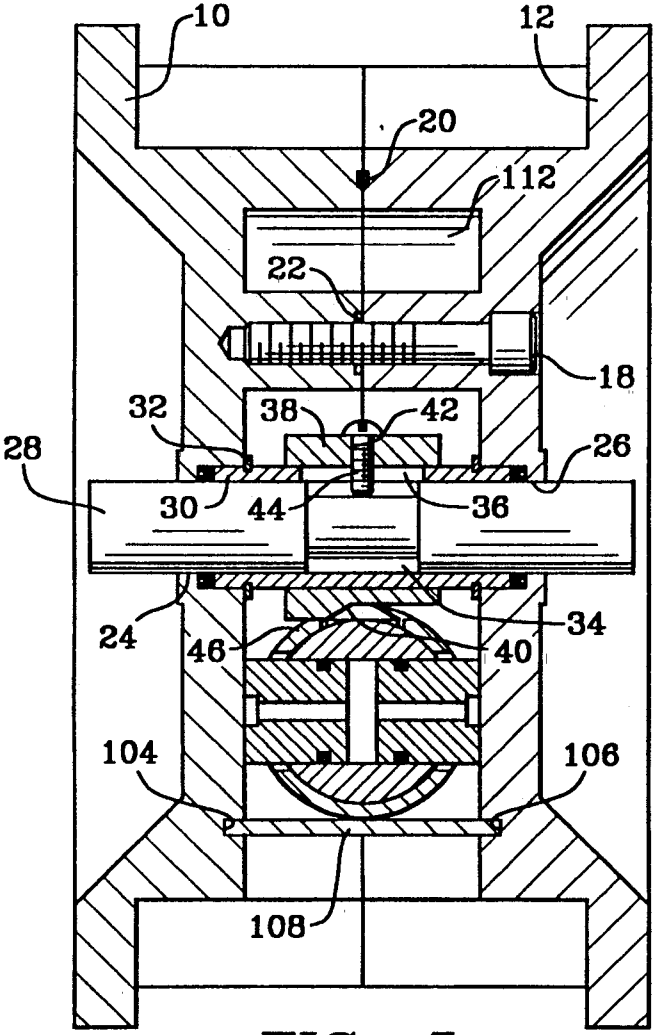
FIG. 5 is a view, like that of FIG. 1, showing an embodiment of the cylinder and piston in place between the plates.

With reference, now, particularly to FIGS. 5 and 6, it will be seen that the cylinder 46 is set within the plates 10 and 12. Plates 10 and 12 have mating, semi-circular reliefs 100 and 102 formed therein in which to nest the opposite ends of the cylinder 46. Further, the plates 10 and 12 have facing, longitudinal grooves 104 and 106 formed therein in which to receive a support panel 108. The panel 108 is slidably engaged with the grooves 104 and 106, and supports the cylinder 46 thereupon. The panel 108 has an aperture 110 formed therein which aligns with the tapped hole 56, and is commonly threaded therewith, to accommodate the fitting 60 therein. With the cylinder so disposed, the axial relief 40, of the block 38, is set directly atop the headed portion 90 of the button-headed valving element 88.

Reverting to FIGS. 5 and 6, it will be seen that the cylinder 46, the bushing 30, and the block 38 are wholly confined within a cavity 112, obtaining between the plates 10 and 12. All of cavity 112, which is not occupied by the aforesaid components, comprises an exhaust chamber. This exhaust chamber, cavity 112 is vented to the atmosphere via a muffler 114 coupled through panel 108.

Figure 1:
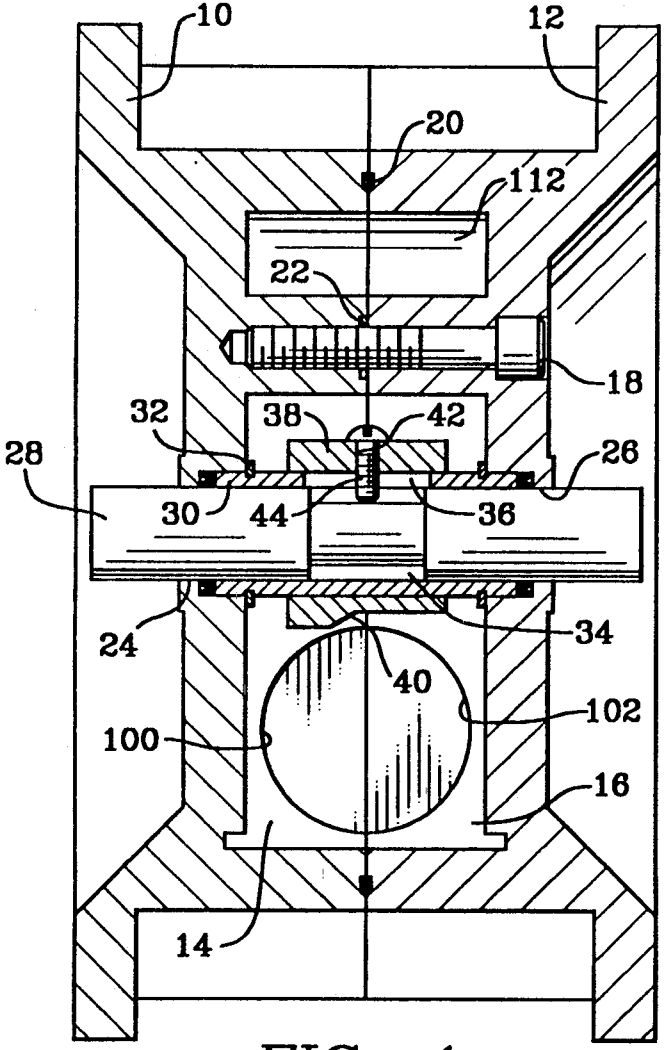
FIG. 1 is a cross-sectional view of a double diaphragm pump subassembly, the same showing the diaphragm-supporting plates, reciprocable rod, and camming sleeve, according to an embodiment of the invention.
Figure 8:
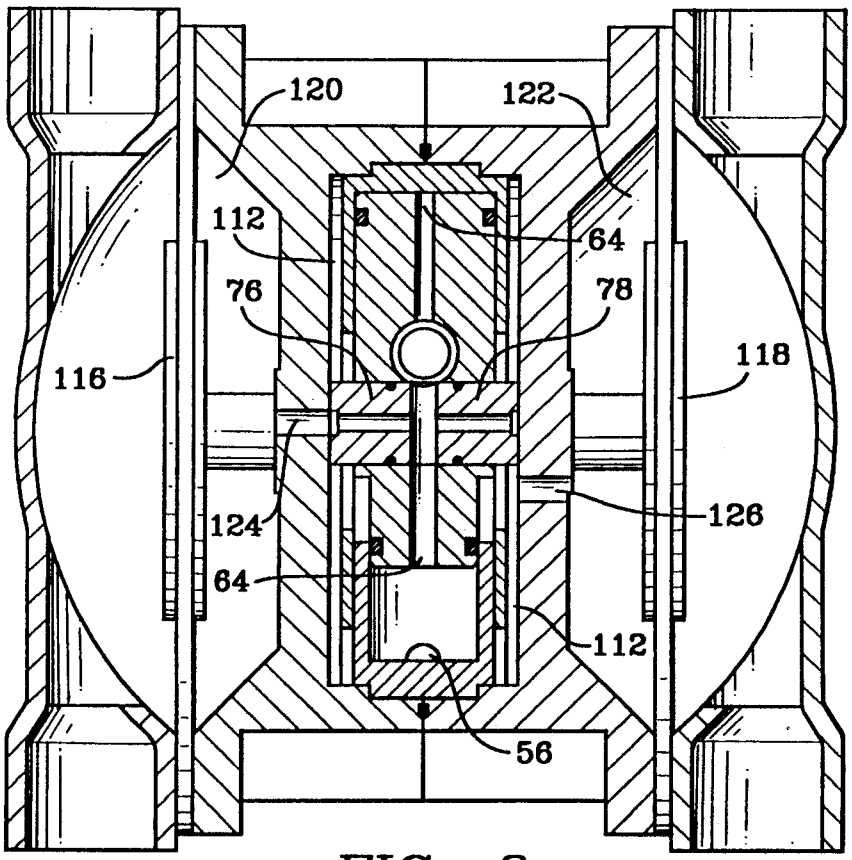
FIGS. 7 and 8 are cross-sectional views of an embodiment of the cylinder and piston, with the piston in both extreme positions thereof, together with the double diaphragms of a pump.
Figure 7:
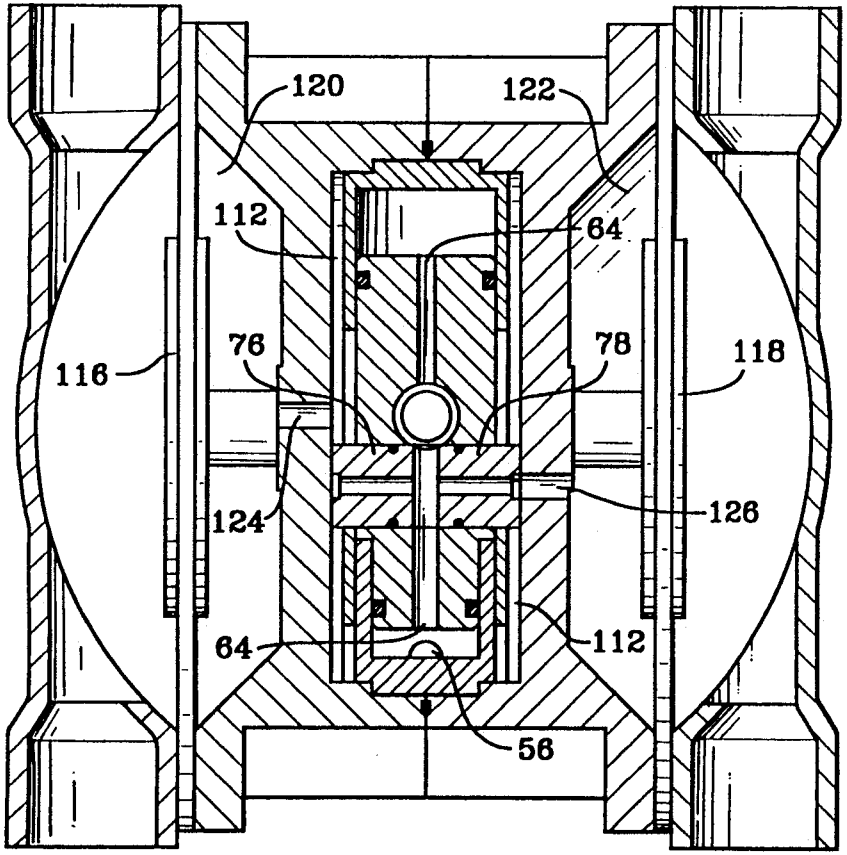

When compressed air is introduced, via the fitting 60, into the plug 52, it enters portion 64 of the bore 62, and into bore 70. In that the round valves 76 and 78 are sealed thereabout, by seals 80, the valves 76 and 78 are forced outwardly; they form an airtight seal against the plates 10 and 12. In addition, the compressed air enters the bore 68 via portion 84. Consequently, the valving element 88 is forced upward against block 38. With diaphragms 116 and 118 coupled to the rod 28 (FIGS. 7 and 8), they cooperate with the plates 10 and 12 to form chambers 120 and 122. Chambers 120 and 122 are put in communication with the exhaust chamber/cavity 112 via ports 124 and 126 formed in the plates 10 and 12. Ports 124 and 126 are not in alignment, however. As a consequence, with reference to FIG. 7, round valve 78 covers port 126, but round valve 76 leaves port 124 open to the chamber/cavity 112. In this position, the air supply flows through the round valve 78, and port 126, and fills chamber 122. As a result, diaphragm 118 is forced outwardly and pulls the rod 28 to the right (as viewed in FIG. 7). As the rod 28 nears the end of its rightward movement, the annular recess 34 engages the shank of the screw 44. This causes the block 38 to move to the right. The left end of the block 38 has no continuation of relief 40 therein, therefore the block cammingly depresses the headed portion 90 of the valving element 88. This opens the portion 66 of bore 62 to the annular relief 98 of the valving element 88, and portion 86 of bore 68; therefore, air in the cylinder 46 which is in communication with portion 66 vents through to chamber/cavity 112. The compressed air admitted via the fitting 60 forces the piston 54 to displace. The piston 54 moves from the disposition shown in FIG. 7 to that shown in FIG. 8. This connects round valve 76 with port 124. The air enters chamber 120, causing the diaphram 116 to deflect and reverse the travel of the rod 28. When the rod 28 nears the end of this reversed stroke, it pulls the block 38 back to its original (FIGS. 1 and 5) position. This allows the valving element 88 to rise again to engage the relief 40, and closes off bore portion 66 from chamber/cavity 112. In that the area of piston 54 within the larger diameter end of the cylinder 46 is larger than the area thereof within the plug 52, the piston 54 is forced downward to assume, again, the disposition thereof shown in FIG. 7. This cyclical process continues as long as compressed air is supplied via the fitting 60.

Unlike prior art dual-diaphragm pump subassemblies, the instant invention confines all of the pump-operating, air valving mechanism within the chamber 112 between the plates 10 and 12. Our novel mechanism exhaust the motive air through no right-angular air passages and, as a consequence the formation of ice, on the valving components, is avoided. Our mechanism has a minimum of parts and components, and these are modularly fitted together; this greatly enhances maintenance and repair as there is little need for disassembly tools. As priorly noted, the round valves 76 and 78 effect air-tight seals against the plates 10 and 12. Consequently, manufacturing tolerances of the two plates need not be stringent; the valves close up against the plates to take up any tolerance deviation.

While we have described our invention, in connection with a specific embodiment thereof, it is to be clearly understood that this is done only by way of example, and not as a limitation to the scope of the invention as set forth in the summary thereof and in the appended claims.

Having described the invention, what is claimed is:

1. An air valving mechanism, in combination with a double diaphragm pump subassembly, comprising:

a pair of plates having confronting cavity recesses formed therein, fastened together, to define a chamber therebetween, wherein said plates have parts, and rod-accommodating apertures formed therein;

a rod slidably disposed in said apertures and having ends thereof extended outwardly from said plates;

a cylinder having a longitudinal axis set within said chamber;

a piston having a first axial bore formed therein, slidable within said cylinder, wherein said piston further has second and third bores, transverse to said axis, formed therein;

first means, slidably disposed in one of said second and third bores, for (a) effecting fluid communication therethrough with said ports, and (b) sealingly engaging said plates and closing off such fluid communication with said ports;

second means, slidably disposed in the other of said second and third bores, for effecting fluid communication of said first bore with said chamber; and means coupled to said cylinder for admitting motive air thereinto for (a) communication of such admitted air with said bores, and (b) slidably translating said piston in said cylinder and said first and second means in said bores.

2. An air valving mechanism according to claim 1, further including:

means coupled to said rod for (a) impinging said second means, and (b) depressing said second means into said other bore.

3. An air valving mechanism according to claim 2, wherein said second means comprises a button-headed valving element having an extended shank, said shank having an annular relief intermediate the length thereof, said other bore having an outwardly-widening termination, and said valving element having a first normal disposition in which said annular relief is closed off from said termination, and a second translated disposition in which said relief is in open communication with said termination.

4. An air valving mechanism, according to claim 3, wherein said shank has annular recesses astride said annular relief, and seals set in said annular recesses.

5. An air valving mechanism according to claim 3, wherein said first axial bore has first and second portions which are out of axial alignment with each other, and one of said portions opens at one end thereof externally of said piston, and at the opposite end thereof onto said annular relief of said shank of said valving element.

6. An air valving mechanism according to claim 5, wherein said second and third bores are interposed between said first and second portions of said first axial bore.

7. An air valving mechanism according to claim 2, wherein said rod has an annular recess formed therein intermediate the length thereof, and further including:

a bushing set about said rod and having opposite ends thereof confined within said plates, wherein said bushing has a slot formed therein, and said impinging and depressing means comprises a camming element set about said bushing and a dowel-like component in penetration of said element, in penetration of said slot, and disposed in said annular recess.

8. An air valving mechanism according to claim 7, wherein said camming element comprises a through-bored block having a camming surface formed thereon, and said camming element is freely slidable on said bushing.

9. An air valving mechanism according to claim 1, wherein said cylinder has an annular plug at one end thereof, and said plug has an air-admitting port formed therein.

10. An air valving mechanism according to claim 9, wherein one axial end of said cylinder has a given inside diameter, said plug having an inside diameter which is smaller than said given inside diameter, said piston having a first diameter slidably disposed in said one axial end of said cylinder, and a second diameter slidably disposed in said plug.

11. An air valving mechanism according to claim 1, wherein said second means comprises a valving element having a button head, said cylinder has a slot formed therein, and said button head is normally intruded into said slot.

12. An air valving mechanism according to claim 1, wherein said second and third bores are in fluid communication therebetween.

13. An air valving mechanism according to claim 1, wherein said plates, in confronting surfaces thereof, have linear grooves formed therein, and further including:

a support panel slidably engaged with said grooves for supporting said cylinder thereupon.

14. An air valving mechanism in combination with a double diaphragm pump subassembly, comprising:

a pair of plates having confronting, cavity recesses formed therein, fastened together, defining a chamber therebetween; and a pump-operating air valving mechanism; wherein said mechanism is wholly confined within said chamber; and said mechanism comprises a cylinder;

said plates being formed with (a) semi-circular reliefs and (b) longitudinal grooves, ends of said cylinder being nested in said semi-circular reliefs; and further including a support panel, slidably engaged with said grooves, supporting said cylinder thereupon.

15. An air valving mechanism according to claim 14, wherein said cylinder has an annular plug at one end thereof, said plug having an air-admitting port formed therein, and said panel having an aperture formed therein which is in registry with said port.

16. An air valving mechanism according to claim 15, wherein said port and said aperature have a common continuous thread formed therein, and further including:

an air-admitting fitting threadedly engaged with said port and aperture.

17. An air valving mechanism according to claim 16, wherein upon removal of said fitting from said port and aperture, and unfastening said separation of said plates, said cylinder is freely removable from said recesses and said panel.

* * * * *